US011674278B2

(12) United States Patent
Giletta

(10) Patent No.: US 11,674,278 B2
(45) Date of Patent: Jun. 13, 2023

(54) METHOD AND SNOW REMOVAL BLADE FOR THE REMOVAL OF SNOW FROM A ROAD SURFACE

(71) Applicant: GILETTA S.p.A., Revello (IT)

(72) Inventor: Enzo Giletta, Revello (IT)

(73) Assignee: GILETTA S.p.A. (IT)

( * ) Notice: Subject to any disclaimer, the term of this patent is extended or adjusted under 35 U.S.C. 154(b) by 626 days.

(21) Appl. No.: 16/422,487

(22) Filed: May 24, 2019

(65) Prior Publication Data

US 2019/0376247 A1 Dec. 12, 2019

(30) Foreign Application Priority Data

May 25, 2018 (IT) ..... 102018000005730

(51) Int. Cl.
*E01H 10/00* (2006.01)
*E01H 5/06* (2006.01)

(52) U.S. Cl.
CPC ..... *E01H 10/007* (2013.01); *E01H 5/061* (2013.01); *E01H 5/066* (2013.01)

(58) Field of Classification Search
CPC ..... E01H 10/007; E01H 5/061; E01H 5/066
See application file for complete search history.

(56) References Cited

U.S. PATENT DOCUMENTS 1,629,160 A * 5/1927 Heermance ..... E01H 5/10 239/130
2,936,537 A 5/1960 Edwin
4,709,492 A * 12/1987 Watson ..... E01H 5/02 172/727
5,515,623 A * 5/1996 Weeks ..... E01H 5/066 239/159
2004/0060201 A1* 4/2004 Schultz et al. ..... E01H 5/066 37/231
2016/0053452 A1 2/2016 Treglown

FOREIGN PATENT DOCUMENTS

| | | | |
|---|---|---|---|
| JP | 2004 204652 | A | 7/2004 |
| JP | 2004204652 | A | 7/2004 |
| KR | 101084684 | B1 | 11/2011 |
| KR | 20170059821 | A | 5/2017 |
| RU | 101457 | U1 | 1/2011 |
| WO | 2011089513 | A2 | 7/2011 |
| WO | WO 2011/089513 | A2 | 7/2011 |

OTHER PUBLICATIONS

Italian International Search Report, Application No. IT201800005730, dated May 25, 2018, pp. 1-8.

* cited by examiner

*Primary Examiner* — Tara Mayo
*Assistant Examiner* — Tara Mayo-Pinnock
(74) *Attorney, Agent, or Firm* — The Belles Group, P.C.

(57) ABSTRACT

A snow removal blade has a rolling body, a snow-removal knife connected to a bottom portion of the rolling body, a plurality of nozzles for delivering a melting liquid on the snow left on the road surface by the snow-removal knife, and a member for mixing together and pressing the residual snow and the melting liquid, which is arranged behind the snow-removal knife in a direction of advance of the snow removal blade, the snow-removal knife and the mixing and pressing member delimiting between them a channel for lateral outlet of the snow, arranged in which are the delivery nozzles.

14 Claims, 2 Drawing Sheets

METHOD AND SNOW REMOVAL BLADE FOR THE REMOVAL OF SNOW FROM A ROAD SURFACE

CROSS-REFERENCE TO RELATED APPLICATIONS

This patent application claims priority from Italian patent application no. 102018000005730 filed on May 25, 2018, the entire disclosure of which is incorporated herein by reference.

TECHNICAL FIELD

The present invention relates to a method and a snow removal blade for the removal of snow from a road surface.

BACKGROUND ART

To remove snow from a road surface it is known to use snow removal blades mounted on board snow-removal vehicles.

Following upon passage of the blade, frequently a layer of residual snow inevitably remains on the road surface. The residual layer, which is constituted by compressed and smoothed snow, is notoriously very slippy and responsible for skidding not only for the vehicles that immediately follow the snow-removal vehicle but also for the ones that travel at a distance of time in so far as the compressed residual layer tends to freeze, thus firmly adhering to the road surface.

Experimentally it has been possible to note how the use of an additional mobile blade arranged on the snow-removal vehicle behind the blade in the direction of travel, albeit effective in the case of powdery snow where it mostly performs an action of brushing, will, instead, not solve the problem of the compressed residual snow; rather, in some cases, it complicates the problem. The main reason for this is that the additional blade is mobile with respect to the blade that precedes it and is pushed towards the road surface by an elastic forcing device, which inevitably allows retraction or rotation thereof. For this reason, the layer of residual snow compressed by the first blade is not scraped away or removed by the additional blade but is even further smoothed, thus worsening even more the state of the road surface.

Once again experimentally it has moreover been possible to note how not even simple sprinkling with various products of the layer of residual snow remaining on the road surface after passage of the knife of the first blade make it possible to solve the problem set forth above in so far as the high degree of compacting generates a barrier that is impermeable to diffusion or penetration of any product.

DISCLOSURE OF INVENTION

The aim of the present invention is to provide a method for removal of snow that will render a simple and inexpensive solution to the problem set forth above possible.

According to the present invention, a method is provided for removal of snow from a snow-covered road surface using a snow removal blade, the method comprising the steps of moving the blade forwards along the road surface to be cleaned, removing, with the snow-removal knife, part of the snow present, thus allowing a compact layer of residual snow to remain on the road surface, and spreading a material for melting the residual snow over the layer of residual snow, and being characterised in that, mixing by means of the mixing and pressing member, the layer of residual snow and said melting material that are present in the lateral outlet channel are mixed together, and, once again by means of the pressing member, the layer of residual snow mixed with the melting material is compressed on the road surface during advance of the mixing and pressing member.

Preferably, according to the method described above, the melting material is delivered in an area of the aforesaid layer of residual snow arranged within the channel closer to the mixing and pressing member rather than to said snow-removal knife.

A further aim of the present invention is to provide a snow removal blade that will be efficient and reliable irrespective of both the type of road surface and the state of the snow present on the road surface.

According to the present invention, a snow removal blade for removing snow from a snow-covered road surface is provided, the blade comprising:

- a rolling body;
- a snow-removal knife connected to a bottom portion of the aforesaid rolling body and adapted to slide, in use, adjacent to the road surface, leaving a layer of residual snow on the road surface; and
- an assembly for supplying a material for melting the snow, the assembly comprising a plurality of delivery nozzles and a circuit for feeding the melting material to said nozzles, characterised in that it further comprises a member for mixing and pressing the residual snow arranged behind said snow-removal knife in a direction of advance of the blade, the snow-removal knife and the mixing and pressing member delimiting between them a lateral outlet channel for the snow, and in that said nozzles comprise respective outlets arranged in the aforesaid channel for sending said melting material onto the residual snow present in the aforesaid lateral outlet channel, said mixing and pressing member being configured to mix together said layer of residual snow and said melting material that are arranged in said lateral outlet channel and for compressing the residual snow mixed with said melting material on the road surface during advance of the member.

BRIEF DESCRIPTION OF THE DRAWINGS

The invention will now be described with reference to the annexed drawings, which illustrate a non-limiting example of embodiment thereof and in which.

BEST MODE FOR CARRYING OUT THE INVENTION

Figure 1:
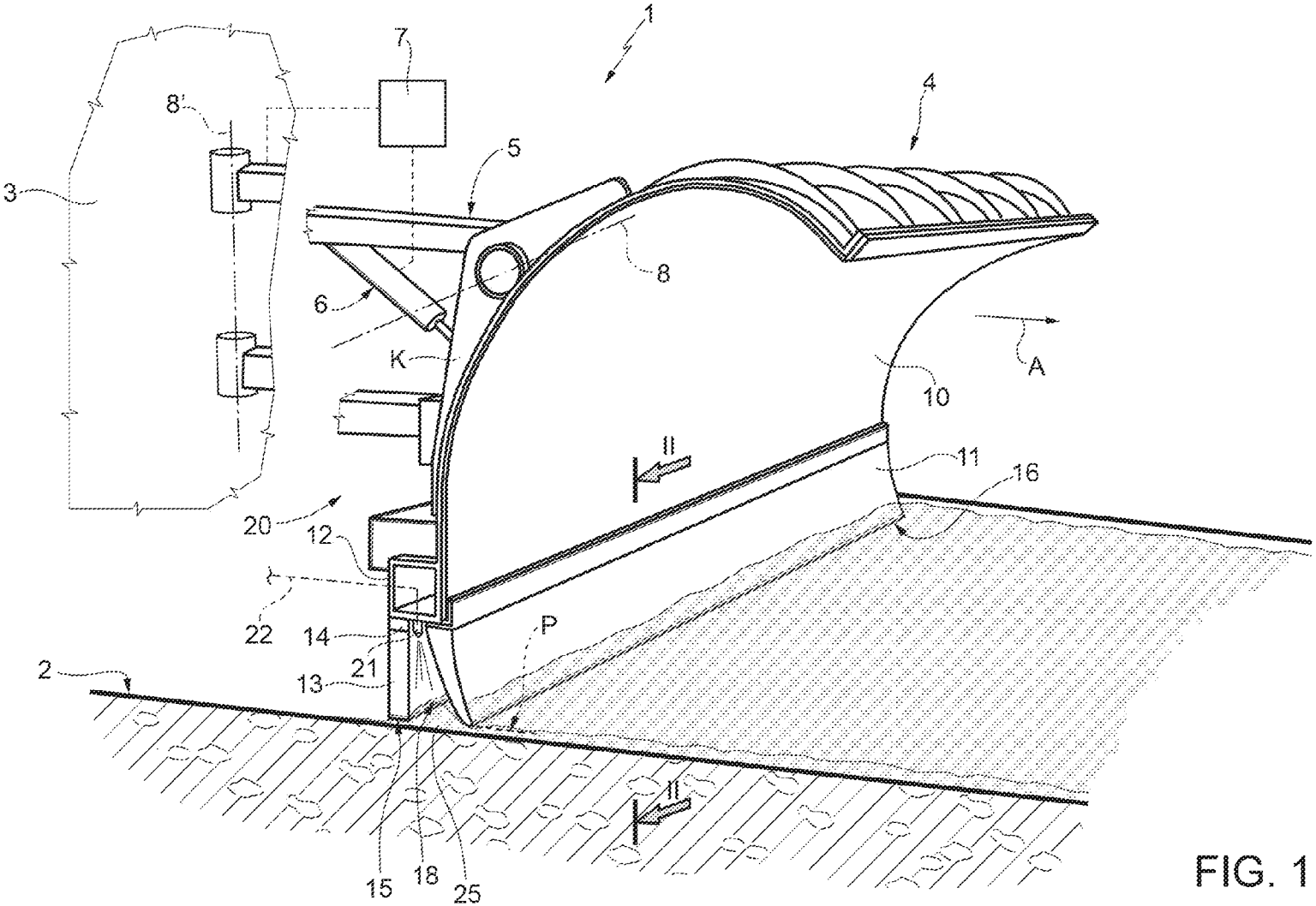
FIG. 1 is a schematic perspective view of a snow removal blade provided according to the teachings of the present invention.

In FIG. 1, designated as a whole by 1 is a motor-driven snow-removal vehicle, illustrated partially, adapted to remove the snow from a road surface 2.

The snow-removal vehicle 1 comprises a tractor 3 (partially illustrated), a snow removal blade 4 pushed by the tractor 3 in a direction A, an articulated arm 5 for attachment of the blade 4 to the tractor 3, and an assembly 6 for moving the blade 4, which is in itself known and partially illustrated. The movement assembly 6 is controlled manually by an operator or else automatically by a control unit 7 for controlling the blade 4, for raising and lowering the blade 4 with respect to the road surface 2, and in general for rotating the blade 4 itself about at least a horizontal adjustment axis 8 and at least about a vertical axis 8', according to operating parameters, such as the quality of the snow, the conditions of the road surface, the speed of the vehicle, etc.

The blade 4 comprises a rolling body 10, and a knife 11 for removal of the snow, which is stably connected to a bottom portion 12 of the rolling body 10 and projects downwards for removing at least part of the snow present on the road surface 2. The snow-removal knife 11 is made of metal material or else polymeric material.

Figure 2:
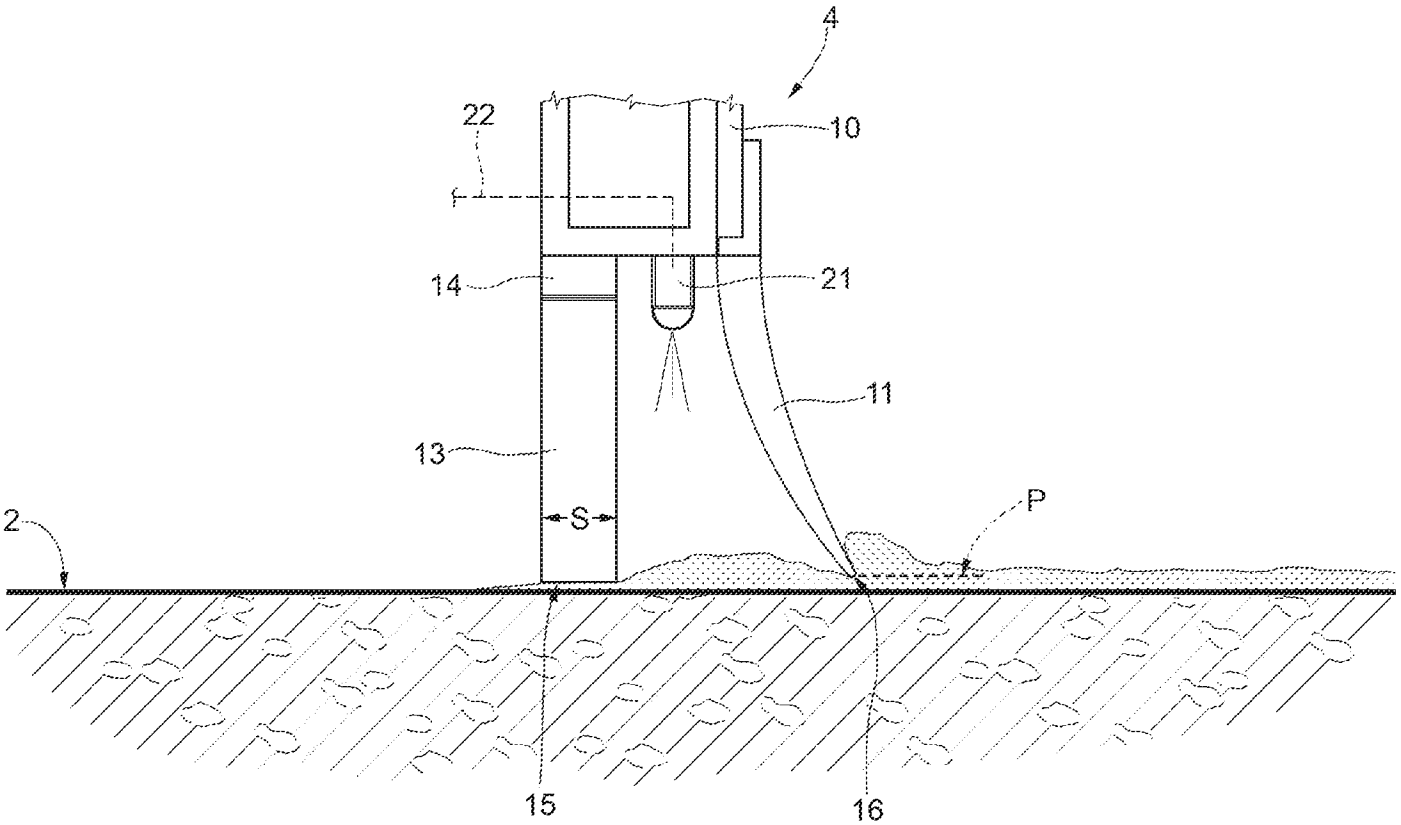
FIG. 2 is a section view, with parts removed for clarity, according to the line II-II of FIG. 1.

With reference to FIGS. 1 and 2, the blade 4 moreover comprises a further knife 13, which is arranged behind the snow-removal knife 11 in the direction A of advance of the blade 4 and in a position facing the snow-removal knife 11 itself.

The knife 13 is delimited, on the side facing the road surface 2, by a plane surface 15. Preferably, the plane surface 15 and the surface 16 that delimits the snow-removal knife 11 at the bottom always lie in a same plane P. As regards what has been mentioned previously, the plane P is a plane that can be adjusted with respect to the road surface 2 both angularly about the axis 8 and in height with respect to the road surface 2 so that it can form angles equal to or other than zero with the road surface 2 and be arranged in contact with, or at a pre-set distance from, the road surface 2 itself.

As may be seen in the attached figures, the knife 13 is a member separate and spaced from the snow-removal knife 11.

According to a first embodiment, the knife 13 is stably connected directly, or by interposition of an interface structure, to the bottom portion 12 of the rolling body 10. Alternatively, the knife is connected to a structure K of the rolling body 10 itself. In all cases, the knife 13 is kept in an operative position always fixed with respect to the snow-removal knife 11.

Alternatively, the knife 13 is coupled, as in the example described, to the bottom portion 12 or to the structure K via a device 14 for discrete or continuous adjustment of recovery of the wear of the knife 13 that is brought about by sliding of the knife 13 on the road surface 2. The device 14 is a unidirectional device; i.e., it enables the knife 13 only to advance with respect to the structure 12 towards the road surface so as to maintain its surface 15 always in the same working position with respect to the structure 12 or the snow-removal knife 11.

Conveniently, the knife 13 is defined by a full or box-shaped plate, preferably, but not necessarily made of polymeric material, which has the same length as the snow-removal knife 11, measured in a direction orthogonal to the direction A, and a thickness S (FIG. 2), measured in the direction A that may vary according to the material used and, specifically, according to the polymeric material used. Experimentally, it has been possible to note that satisfactory results are obtained with knives made of polymeric material having a thickness S ranging between 40 and 50 mm.

In any case, the snow-removal knife 11 and the knife 13 delimit between them a channel 18 for lateral outlet of the snow, which has a constant section of passage.

Once again with reference to the attached figures, the blade 4 further comprises an assembly 20 for feeding a melting or de-icing material on just the mass of snow instantaneously present in the channel 18. The melting material may be granular or, conveniently, be a liquid solution, as in the example described.

The assembly 20 comprises one or more delivery nozzles 21, just one of which is visible in the attached figures, and a circuit 22 (illustrated schematically) for feeding the liquid solution to the nozzles 21.

Preferably, the blade 4 comprises a row of nozzles 21 coupled to the portion 12 between the knives 11 and 13. The nozzles 21 have respective outlets arranged in the channel 18 for directing the melting material towards the road surface 2.

Conveniently, the nozzles 21 are external to and separate from both the snow-removal knife 11 and the knife 13.

Preferably, the nozzles 21 are arranged closer to the knife 13 rather than to the snow-removal knife 11.

Conveniently, the nozzles 21 are set up against the knife 13. Experimentally, it has been possible to note that by increasing the vicinity to the knife 13 the efficiency of the blade 4 increases. Conveniently, furthermore, the nozzles 21 are raised from the road surface 2, as may be seen in FIGS. 1 and 2, and arranged at a distance from the road surface 2 itself ranging between 5 and 250 mm.

In any case, the nozzles 21 are separate and distinct both from the snow-removal knife 11 and from the knife 13. The clear separation of the nozzles 21 from the knives 11 and 13 from a constructional standpoint simplifies the blade 4 and enables a more convenient cleaning of the nozzles 21 themselves in the case where this were to become necessary, in so far as the nozzles rarely come into direct contact with the snow that passes through the channel 18.

The nozzles 21 may be fixed nozzles or nozzles that can be oriented manually or automatically under the control of the control unit 7. Irrespective of whether they are fixed nozzles or orientable nozzles, the nozzles 21 direct respective flows of material into an area of the channel 18 closer to the knife 13 than to the snow-removal knife 11 or in an area immediately in front of the knife 13. Alternatively, at least a part of the flow of melting material could be directed onto the knife 13, the lateral surface of which contributes to forming a film of liquid and to directing the aforesaid film towards a front edge of the knife 13. Experimentally it has, however, been possible to note that it is preferable to direct the flow of material towards the road surface, and not onto the knife 13.

In use, the blade 4 is lowered onto the road surface 2 to be cleaned, simultaneously bringing the knives 11 and 13 into contact with the road surface 2 or into a position slightly raised from the road surface 2 itself, and is then moved forwards in the direction A.

Irrespective of the position of the blade 4, a minimal amount of residual snow inevitably remains present on the road surface 2 after passage of the snow-removal knife 11, forming in the channel 18 a compact layer of snow pressed on the road surface 2 itself. At this point, just the portion of the layer of residual snow arranged within the channel 18 and designated by 25 in FIG. 1 is sprayed with the liquid fed by the nozzles 21. The problem of lack of penetration of the sprayed melting material caused by the barrier opposed by the compressed residual snow is solved by the knife 13, which, since it cannot shift from its operative position, first mixes the melting liquid with the residual snow, thus breaking down the aforesaid barrier impermeable to diffusion of the liquid and forming a residual snow-liquid solution, where the liquid is evenly dispersed in the residual snow, and then presses the residual snow-liquid solution, compressing it against the road surface as the blade advances.

Compression of the solution is to a large extent due to the fact that the solution is forced to pass into the fixed space comprised between the surface 15 and the road surface 2.

This action of compression produces a rapid transformation of the residual snow into water and prevents subsequent freezing thereof since also the melting liquid is present in the water.

Experimentally it has been possible to note how the diffusion and therefore mixing of the liquid with the residual snow are the faster, the more the flow of liquid is directed towards an area of the layer of residual snow closer to the knife 13 rather than to the snow-removal knife 11 and even more so when an amount of liquid is immediately available upstream of the knife 13 or partially on it.

From the foregoing it is evident how the knife 13, on account of how it is made and/or is connected to the rolling body, is to all effects a fixed mixing and compression member that progressively, as the blade 4 advances, mixes and compresses the part of residual snow blocked in the channel 18, thus contributing to its removal from the road surface.

The invention claimed is:

1. A method for removing snow from a snow-covered road surface comprising:

providing a snow removal blade, the blade comprising a rolling body, a removal knife connected to a lower portion of said rolling body and configured to slide adjacent a road surface, a feeding assembly, and a mixing and pressing member arranged behind said removal knife in a forward movement direction of the blade, the feeding assembly comprising a melting material, a plurality of delivery nozzles, the plurality of delivery nozzles comprising outlets arranged in a channel defined by the removal knife and the mixing and pressing member;

moving the blade forward along the road surface to be cleaned;

removing part of the snow with the removal blade, allowing a layer of compact residual snow to remain on the road surface;

spraying the melting material through the outlets of the plurality of nozzles onto the layer of residual snow, the melting material exiting the outlets of the plurality of nozzles as a liquid; and mixing the layer of residual snow with said melting material present in the channel by means of the mixing and pressing member.

2. The method according to claim 1, characterised in that the melting material is delivered to area of said layer of residual snow arranged within the channel which is closer to the mixing and pressing member than to said removal knife.

3. The method according to claim 1, characterised in that said melting material is delivered immediately upstream and/or partially above said mixing and pressing member.

4. The method according to claim 1, characterised in that the compression of the residual snow mixed with the melting material is carried out by keeping the mixing and pressing member in a fixed position with respect to the rolling body of the snow removal blade.

5. The method according to claim 1 wherein the lower portion of the rolling body comprised a tubular structure forming an upper surface of the channel, the plurality of nozzles mounted to the tubular structure of the rolling body and extending from the upper surface of the channel.

6. A snow removal blade for removing snow from a snow-covered road surface; the blade comprising:

a rolling body;

a removal knife connected to a lower portion of said rolling body and adapted to slide, in use, adjacent to the road surface thus leaving a layer of residual snow on the road surface;

a feeding assembly, for supplying a snow melting material, the assembly comprising a snow melting material, a plurality of delivery nozzles, and a circuit for feeding the melting material to said nozzles, characterised in that it furthermore comprises, a mixing and pressing member for the residual snow arranged behind said removal knife in a forward movement direction of the blade; the removal knife and the mixing and pressing member delimiting between them, a lateral snow outlet channel, and in that said nozzles comprise respective outlets arranged in said channel for sending the melting material onto the residual snow present in said lateral outlet channel, said mixing and pressing member being configured to mix said layer of residual snow with said melting material arranged in said lateral outlet channel and for compressing the residual snow mixed with said melting material on the road surface during its forward movement;

wherein said nozzles are arranged closer to the mixing and pressing member than to the removal knife; and wherein the lower portion of the rolling body comprises a tubular structure forming an upper surface of the channel, the plurality of nozzles mounted to the tubular structure of the rolling body and extending from the upper surface of the channel.

7. The blade according to claim 6, characterised in that said mixing and pressing member is separated from said removal knife and said nozzles are outside of or separated from both the removal knife and the mixing and pressing member.

8. The blade according to claim 6, characterised in that said mixing and pressing member is fixed to said rolling body.

9. The blade according to claim 6, characterised in that said mixing and pressing member is fixed in respect to said removal knife.

10. The blade according to claim 6, characterised in that said nozzles are arranged alongside said mixing and pressing member.

11. The blade according to claim 6, characterised in that said removal knife and said mixing and pressing member have respective end surfaces facing, in use, the road surface arranged, in use, at the same height from the road surface.

12. The blade according to claim 6, characterised in that said removal blade and said mixing and pressing member have respective end surfaces facing, in use, the road surface lying on a shared flat plane.

13. The snow removal blade according to claim 6, wherein the plurality of delivery nozzles are oriented relative to the rolling body via a control unit.

14. The snow removal blade according to claim 6 wherein the snow melting material is dispensed from the nozzles as a liquid.

* * * * *